United States Patent [19]

Verdier et al.

[11] Patent Number: 4,754,669

[45] Date of Patent: Jul. 5, 1988

[54] MOTOR DRIVEN SCREWDRIVER WITH SPINDLE LOCK

[75] Inventors: Alain Verdier, Lyon; Alain Serriere, Dardilly, both of France

[73] Assignee: Black & Decker Inc., Newark, Del.

[21] Appl. No.: 922,059

[22] Filed: Oct. 22, 1986

[30] Foreign Application Priority Data

Oct. 24, 1985 [FR] France ..... 85 15822
May 2, 1986 [FR] France ..... 86 06385

[51] Int. Cl.[4] ..... B25B 21/00
[52] U.S. Cl. ..... 81/57.14; 81/60
[58] Field of Search ..... 81/57.14, 57.22, 57.3, 81/57.31, 54, 57, 57.11, 58, 58.3, 58.4, 60, 63.1, 467

[56] References Cited

U.S. PATENT DOCUMENTS

| | | | |
|---|---|---|---|
| 3,638,519 | 6/1970 | Rebold | 81/177 |
| 3,673,921 | 7/1972 | Fritts et al. | 91/299 |
| 3,802,518 | 4/1974 | Albert | 173/29 |
| 4,078,589 | 3/1978 | Miller | 81/57.14 |
| 4,448,098 | 5/1984 | Totsu | 81/57.11 |

FOREIGN PATENT DOCUMENTS

| | | |
|---|---|---|
| 0088836 | 9/1983 | European Pat. Off. . |
| 0118215 | 9/1984 | European Pat. Off. . |
| 1447803 | 9/1965 | France . |
| 318623 | 12/1928 | United Kingdom . |
| 853407 | 11/1960 | United Kingdom . |

*Primary Examiner*—Frederick R. Schmidt
*Assistant Examiner*—Bradley I. Vaught
*Attorney, Agent, or Firm*—Edward D. Murphy; Dennis Dearing; Edward D. C. Bartlett

[57] ABSTRACT

In a portable motorized screwdriver, in order to provide for manual use of the screwdriver, to finish screwing in a screw, for example, or to start unscrewing a screw, a mechanism is provided for locking the spindle. This mechanism is coupled to the switch used to start and stop rotation of the spindle. This coupling is arranged so that operation of the switch to start rotation of the spindle is accompanied by unlocking of the spindle and so that returning the switch to the position to stop rotation of the spindle locks the spindle. The locking mechanism is arranged so that when the spindle is locked the screwdriver may be used as a ratchet type manual screwdriver.

21 Claims, 7 Drawing Sheets

MOTOR DRIVEN SCREWDRIVER WITH SPINDLE LOCK

BACKGROUND OF THE INVENTION

1. Field of the Invention

The present invention concerns a portable motorized screwdriver or "electric" screwdriver.

2. Description of the Prior Art

This type of screwdriver is well known and generally comprises, on a casing designed to be held in the hand, a rotatable tool-bearing spindle that a usually electric motor housed within the casing drives in rotation in a selected screwing or unscrewing direction; to this end there are provided on the casing manually operated switching means for selecting one or other of these directions of rotation and starting and stopping the motor.

To enable the user of this type of screwdriver to further tighten a screw by applying to it a screwing torque greater than that which the motor can provide or to start unscrewing a screw by applying to it an unscrewing torque also greater than the torque that the motor can provide, without the user having to employ a manual screwdriver for this purpose, it has already been proposed in the prior art to provide such motorized screwdrivers with means for locking the spindle against rotation relative to the casing; to this end U.S. Pat. No. 3,802,518 provides a freewheel device between the motor and spindle, the device being adapted to be actuated by manual translation of a sleeve external to the casing to immobilize the spindle against rotation in one direction or the other, at will; U.S. Pat. No. 4,078,589 and European patent application No. 0,118,215 describe a provision for locking the spindle against rotation by means of a pin operated from outside the casing by manually actuating a button or sleeve, with no possibility of choosing the immobilization direction.

Although the various methods of locking the spindle against rotation proposed in the prior art make effective provision for using the motorized screwdriver as a conventional manual screwdriver, which makes any such motorized screwdriver more convenient to use, they nevertheless have a serious disadvantage in that they are totally dissociated from the switching means used to start and stop the motor; because of this, there is mothing to prevent the motor being started with the spindle locked against rotation, with the serious risk, vitually a certainty, of seriously damaging the motor.

An object of the present invention is to eliminate this risk.

SUMMARY OF THE INVENTION

The invention consists in a portable motorized screwdriver comprising a tool-bearing spindle, drive means adapted to rotate said spindle in respective opposite directions, manual switching means adapted to cause said drive means selectively to rotate said spindle in one or other of said respective opposite directions or to stop said drive means, and locking means adapted to enable or prevent rotation of said spindle coupled to said manual switching means in such a way that actuation of said manual switching means to cause said drive means to rotate said spindle in one or other of said respective opposite directions causes said locking means to enable rotation of said spindle at least in said one or other of said respective opposite directions.

In one embodiment of the invention lending itself to particularly simple and economic implementation, as will emerge hereinafter, the locking means are coupled to the manual switching means in such a way that actuating the manual switching means to stop the drive means causes the locking means to prevent the spindle rotating in either of the respective opposite directions; when the drive means are stopped, the motorized screwdriver in accordance with the present invention may therefore be used like an ordinary manual screwdriver, the blade and the handle of which are constrained to rotate together in both directions.

In a more sophisticated embodiment, wherein the manual switching means are adapted to authorize preselection of one or other of the respective opposite directions when the drive means are stopped, the locking means are coupled to the manual switching means in such a way that actuating the manual switching means to stop the drive means with a first of the respective opposite directions preselected causes the locking means to prevent rotation of the spindle in the second of the respective opposite directions and to enable rotation of the spindle in the first direction; thus when the drive means are stopped the screwdriver in accordance with the present invention may be used like a manual rachet screwdriver, in a particularly convenient way.

In this more sophisticated embodiment of the invention, when the drive means comprise in the known way a motor and a transmission system coupling the motor to the spindle and the manual switching means comprise, also in the known way, means for starting and stopping the motor, the transmission system advantageously comprises clutch means that are engaged when the motor is running and disengaged when the motor is stopped, the locking means cooperating with the transmission system on the output side of the clutch means, that is to say between the latter and the spindle; in this way use of the motorized screwdriver like a manual rachet screwdriver does not entail any rotation of the motor, which therefore does not exert any torque resisting rotation of the spindle in the direction authorized by the locking means.

Whether the simpler or the more sophisticated embodiment of the invention is chosen, it is advantageous to provide time-delay means for delaying locking of the spindle relative to stopping of the drive means and for delaying starting of the drive means relative to releasing of the spindle; in this way it is sure that the locking means will never immobilize the spindle before it has completely stopped rotating and that the motor will never begin to operate before the spindle is released by the locking means after a period of immobilization.

Furthermore, to prevent the spindle being immobilized before the motor has completely stopped, when the drive means comprise a direct current electric motor having first and second power supply terminals and the manual switching means comprise means for connecting the first and second terminals of the motor respectively to first and second terminals of a direct current power supply in order to operate the drive means so as to rotate the spindle in one of the respective opposite directions and means for connecting the first and second terminals of the motor respectively to the second and first terminals of the power supply in order to operate the drive means so as to rotate the spindle in the other of the respective opposite directions, the manual switching means preferably comprise means for connecting the first and second terminals of the motor together and isolating them from at least one of the terminals of the power supply in order to stop the drive means; short-circuiting the two terminals of the direct current motor in this way makes effective provision for braking the motor and consequently stopping it as quickly as possible.

Other characteristics and advantages of the invention will emerge from the following description given by way of non-limiting example only with reference to the accompanying drawings which constitute an integral part of the description.

DESCRIPTION OF THE PREFERRED EMBODIMENTS

Figure 1:
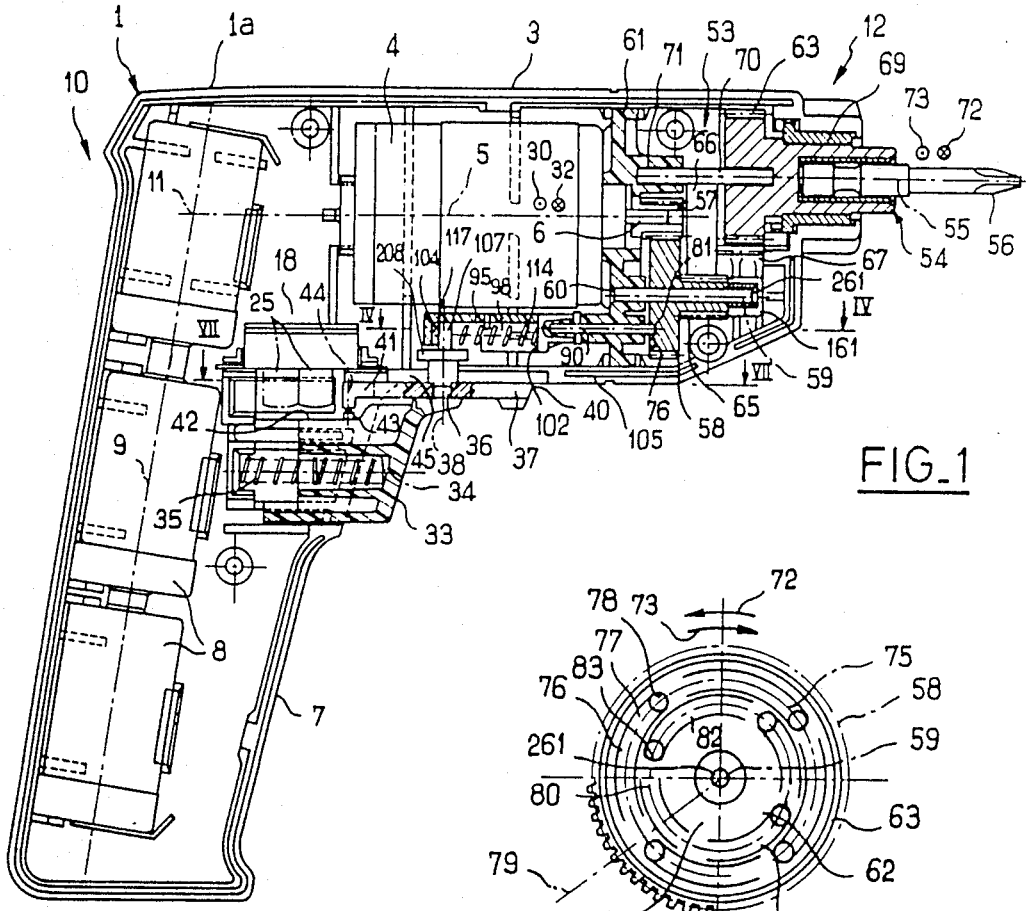
FIG. 1 is a general view of a motorized screwdriver in accordance with the invention with the casing opened and partially in cross-section on a plane of symmetry of the casing passing through the axis of rotation of the spindle.
Figure 2:
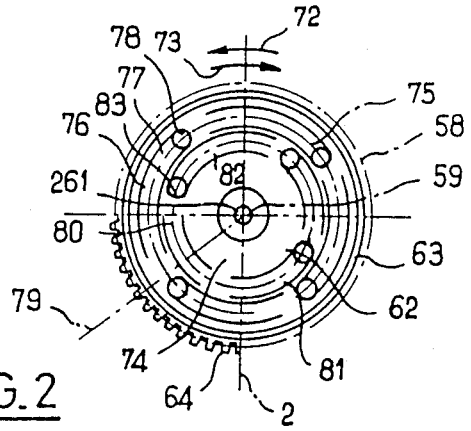
FIG. 2 is an axial view of a gearwheel forming part of the transmission system between the motor and the tool-bearing spindle.

Referring first to FIG. 1, a rigid casing 1 of plastics material is formed by assembling together two shells 1*a* and one 1*b* on a plane 2 relative to which the two shells 1*a* and 1*b* are symmetrical to each other; the shell 1*b* and the plane 2 are seen in FIGS. 4 through 8, 10 through 12 and 16 through 18.

In the preferred embodiment shown, the casing 1 is generally pistol-shaped and thus comprises:

a body area 3 inside which is accommodated a direct current electric motor 4 having on an axis 5 located in the plane 2 an output shaft 6 adapted to be driven in rotation about the axis 5 in one direction or the other according to how the motor 4 is supplied with electricity, a hand grip butt area 7 inside which are accommodated electric batteries 8 to supply electricity to the motor 4, the batteries 8 being disposed along a mean axis 9 intersecting an extension of the axis 5 on the opposite side of the motor 4 relative to the output shaft 6; the part of the body 3 surrounding the intersection 11 of the axis 5 and the mean axis 9, that is to say the area where the butt 7 merges the body 3, will be referred to by convention as the "back" 10 whereas the part of the body 3 surrounding in particular the output shaft 6 of the motor, on the opposite side of the motor relative to the back 10 along the axis 5, will be referred to as the "front" 12.

Figure 9:
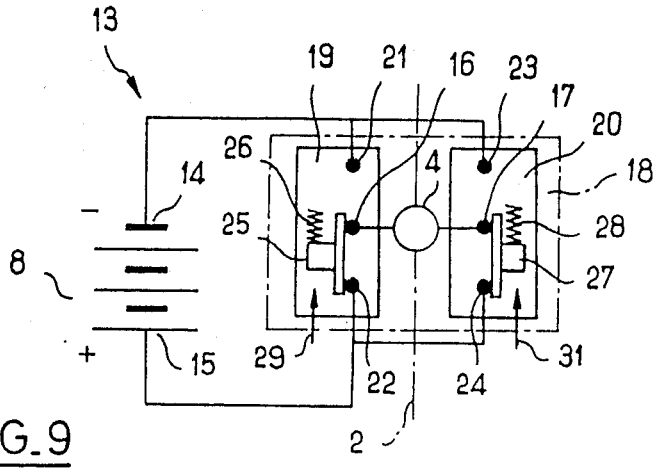
FIG. 9 is a circuit diagram showing the power supply to the electric motor of the screwdriver.

In addition to the motor 4 and the electric batteries 8, the casing 1 also accommodates a circuit 13 for supplying electricity to the motor 4 from the batteries 8; FIG. 9 is a schematic of the circuit 13 showing the negative terminal 14 of the batteries 8 connected in series, the positive terminal 15 of the batteries, two terminals 16 and 17 through which the motor 4 is supplied with electricity, and a reversing switch assembly 18 which, as can be seen in FIG. 1, is accommodated in the body 3 where this joins onto the butt 7.

As can be seen in FIG. 9, the reversing switch 18 comprises two single-pole switches 19 and 20 each of which has three aligned terminals, namely a central terminal connected to the terminal 16 of the motor in the case of the single-pole switch 19 and to the terminal 17 of the motor in the case of the single-pole switch 20, and two end terminals, namely a terminal 21 connected to the negative terminal 14 of the batteries 8 and a terminal 22 connected to the positive terminal 15 of the batteries 8 in the case of the single-pole switch 19 and a terminal 23 connected to the negative terminal 14 of the batteries 8 and a terminal 24 connected to the positive terminal 15 of the batteries 8 in the case of the switch 20; the switch 19 includes a slider 25 which slides in a direction parallel to the alignment of the terminals 16, 21, 22 to establish selectively an electrical connection between the central terminal 16 and either the terminal 21 or the terminal 22; a spring 26 urges the slider 25 into a position where it establishes the circuit between the terminal 16 and the terminal 22, this being its unoperated state; the switch 20 includes a slider 27 to establish selectively an electrical connection between the central terminal 17 and either the terminal 23 or the terminal 24, a spring 28 rendering the latter position, in which contact is established between the terminal 17 and the terminal 24, the unoperated position of the switch 20.

When the two switches 19 and 20 are unoperated the terminals 16 and 17 of the motor are connected by the sliders 25 and 27 and the terminals 22 and 24 to the same terminal of the battery 8, namely the positive terminal 15 thereof, which short-circuits together the terminals 16 and 17 of the motor 4 and, by virtue of the nature of the motor, immobilizes its output shaft 6 against rotation about the axis 5.

Inside the casing 1 the switches 19 and 20 are disposed on respective sides of the plane 2, symmetrically to each other with respect to this plane, as is indicated by the schematic representation of the sliders 25 and 27 in FIGS. 4 through 8, 10 through 12 and 16 through 18; to be more precise, in the embodiment described and shown, if it is assumed that the butt 7 is turned downwardly relative to the body 3 and that the screwdriver is observed in the direction from the back 10 towards the front 12 parallel to the axis 5, the switch 19 is situated to the right of the plane 2, the alignment of the terminals 21, 16, 22 being parallel to this plane and to the axis 5 of the motor with the terminal 22 situated to the front of the terminal 16 in turn situated to the front of the terminal 21; given the same observation conditions, the switch 20 is situated on the left of the plane 2 and the alignment of the terminals 23, 17, 24 is parallel to this plane and the axis 5, the terminal 24 being situated to the front of the terminal 17 in turn situated to the front of the terminal 23; thus the springs 26 and 27 urge the sliders 25 and 27 towards the front and by applying a thrust 29 towards the back to the slider 25 without touching the slider 27 the electrical connection between the terminal 16 and the terminal 22 is cut and a connection is established between the terminal 16 and the terminal 21, while the terminal 17 remains electrically connected to the terminal 24, which makes it possible to supply electricity to the motor 4 in such a way that its output shaft 6 is driven in rotation about the axis 5 in a direction 30, this being the clockwise direction when the screwdriver is seen in the direction from the back 10 towards the front 12 parallel to the axis 5; similarly, assuming the slider 25 is in the unoperated position, if a thrust 31 towards the back is applied to the slider 27 the slider moves to a position in which it connects terminal 17 to the terminal 23 instead of the terminal 24 while the terminal 16 remains connected to the terminal 22, which causes supply of power to the motor 4 in such a way that its output shaft 6 turns about the axis 5 in a direction 32 opposite to the direction 30; if the two sliders 25 and 27 were inadvertently moved towards the back at the same time, both the terminals 16 and 17 would be connected via the terminals 21 and 23 to the same terminal 14 of the electric batteries 8, which would safely immobilize the motor; immediately the thrust 29 or 31 applied to one or other of the sliders 25 and 27 were to cease, the corresponding spring 26 or 28 would naturally move the slider back towards the front, into a position of electrical connection between the terminal 16 and the terminal 22 or between the terminal 17 and the terminal 24.

Figure 4:
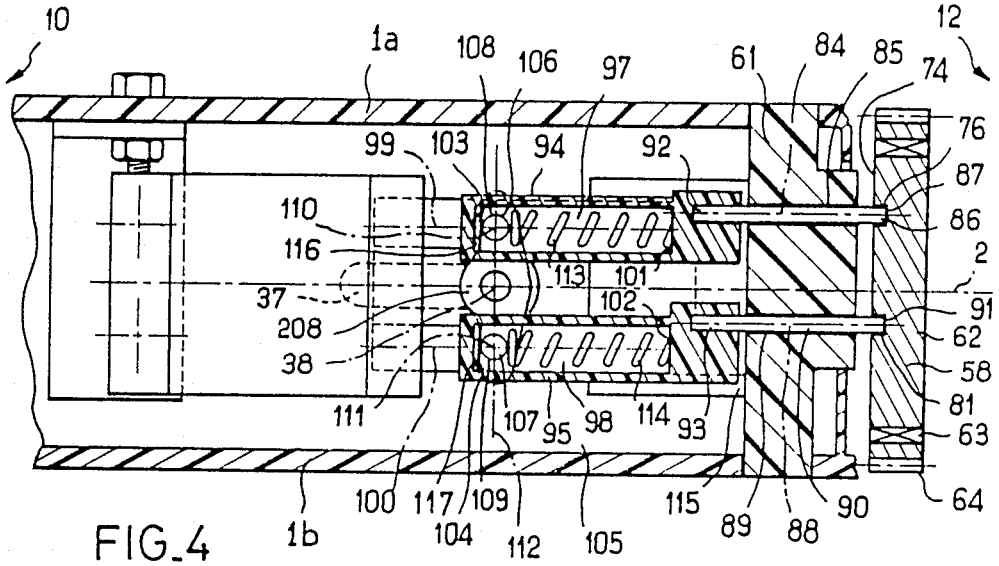
FIG. 4 is a partial view in cross-section on the line IV—IV in FIG. 1.
Figure 5:
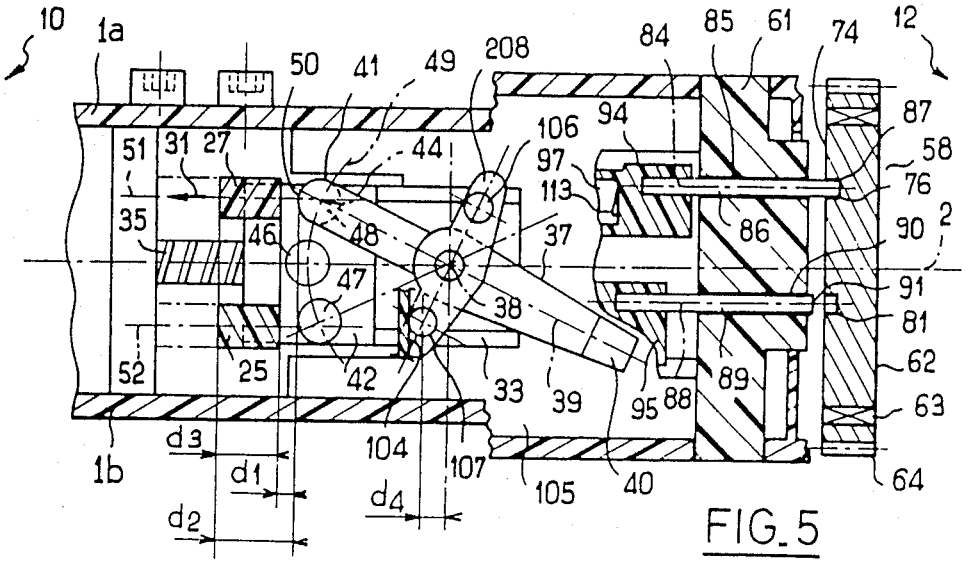
FIGS. 5 through 8 show respective states of the switching means and the spindle locking means, being views in cross-section on the parallel lines IV—IV and VII—VII in FIG. 1.
Figure 6:
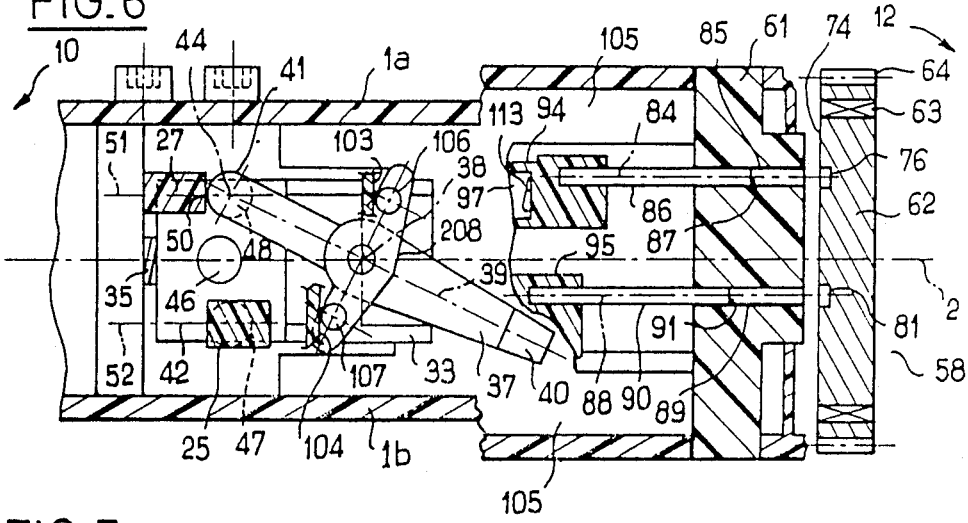
Figure 7:
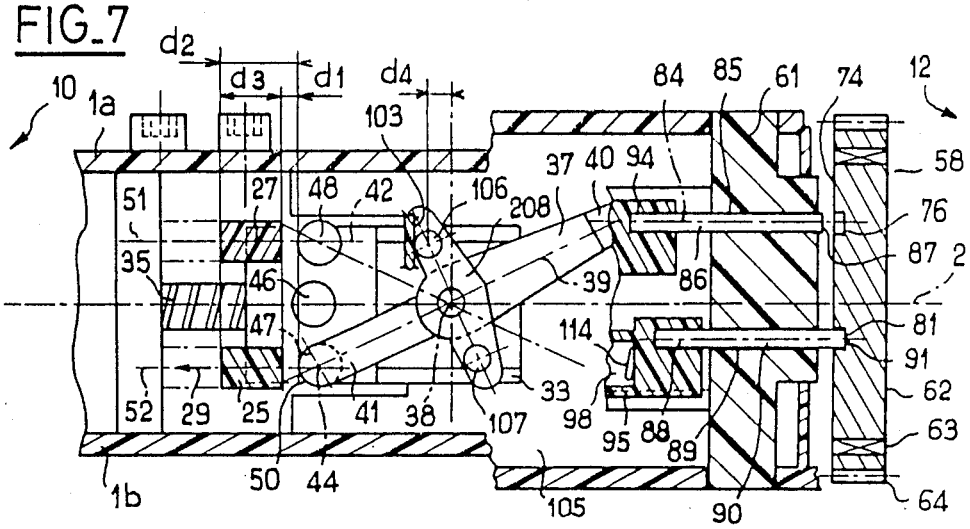
Figure 8:
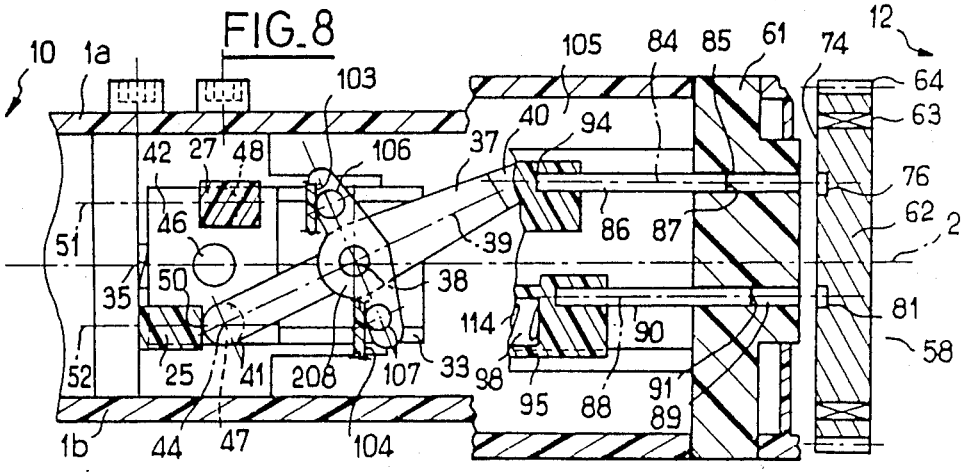

Referring again to FIG. 1, in which the slider 25 is shown in full line in its unoperated position, that is to say establishing a connection between the terminals 16 and 22, and in chain-dotted line in the position in which it establishes a connection between the terminal 16 and the terminal 21, it is seen that the sliders 25 and 27 are placed within the casing 1 in such a way as to be inaccessible from outside the casing and so as to be operable only through the intermediary of a trigger 33 which projects from the casing 1 at the front of the butt 7 where this joins to the body 3 and which is guided, in a known manner, for sliding relative to the casing 1 in a direction 31 parallel to the axis 5 between abutment means (not shown) defining a position of maximum projection of the trigger 33 out of the casing 1, which position is shown in FIG. 1 and in FIGS. 4, 5, 7, 10 through 12, 17 and 18, and a position of maximum retraction within the casing 1, shown in FIGS. 6 and 8, in which the trigger 33 is flush with the casing 1; the position of maximum projection is situated to the front of the position of maximum retraction and, in a way that is known in itself, a spring 35 urges the trigger 33 to slide towards the front relative to the casing 1, so that the maximum projection position is an unoperated position associated with stopping of the motor through the positioning of the sliders 25 and 27 in the position in which they establish respective electrical connections between terminals 16 and 22 and between terminals 17 and 24.

In the immediate vicinity of the body 3 the trigger 33 carries a lug 36 carrying a lever 37 which selects the direction of rotation of the shaft 6 of the motor 4, the lever 37 being guided by the lug 36 to rotate relative to the trigger 33 about an axis 38 in the plane 2 and perpendicular to the axis 5 and to the direction 34.

The lever 37, also visible in FIGS. 4 through 8, 10 through 12 and 16 through 18, has a specific mean direction 39 which, by pivoting of the lever 37 about the axis 38 relative to the trigger 33, may be brought into a position shown in FIGS. 1, 4, 10 and 16 in which it is situated in the plane 2; in this so-called "neutral" position the lever 37 features to the front of the axis 38, along its mean direction 39, an area 40 situated outside the casing 1 and authorising manual actuation of the lever 37 in rotation about the axis 38 relative to the trigger 33; similarly, when in this position the lever 37 features to the rear of the axis 38 a rectilinear part 41 extending into the casing 1 and featuring, in the direction towards a flat face 42 on the trigger 33 perpendicular to the axis 38, a latching finger 43 urged elastically towards this face 42 along an axis 44 parallel to the axis 38 and fixed relative to the lever 37; in order to receive the finger 43 in three particular orientations of the mean direction 39 of the lever 37 and of the trigger 33, the face 42 of the trigger 33 features three localized depressions 46, 47, 48 with the same circular profile centered on a common circle 49 itself centered on the axis 38; the depression 46 is centered on the intersection of the circle 49 with the plane 2 in order to receive the finger 43 so as to immobilize the lever 37 by elastic latching relative to the trigger 33 when the lever 37 occupies the neutral position shown in FIGS. 1, 4, 10 and 16 and in which its direction 39 lies in the plane 2; the depressions 47 and 48 are situated symmetrically to each other relative to the plane 2, respectively on the same side of this plane as the slider 25 and on the same side of this plane as the slider 27, although they remain, like the depression 46, generally to the rear of the axis 38; with reference to this axis the depressions 47 and 48 are therefore offset angularly by less than 90°, by 30° in this example, relative to the depression 46.

Figure 11:
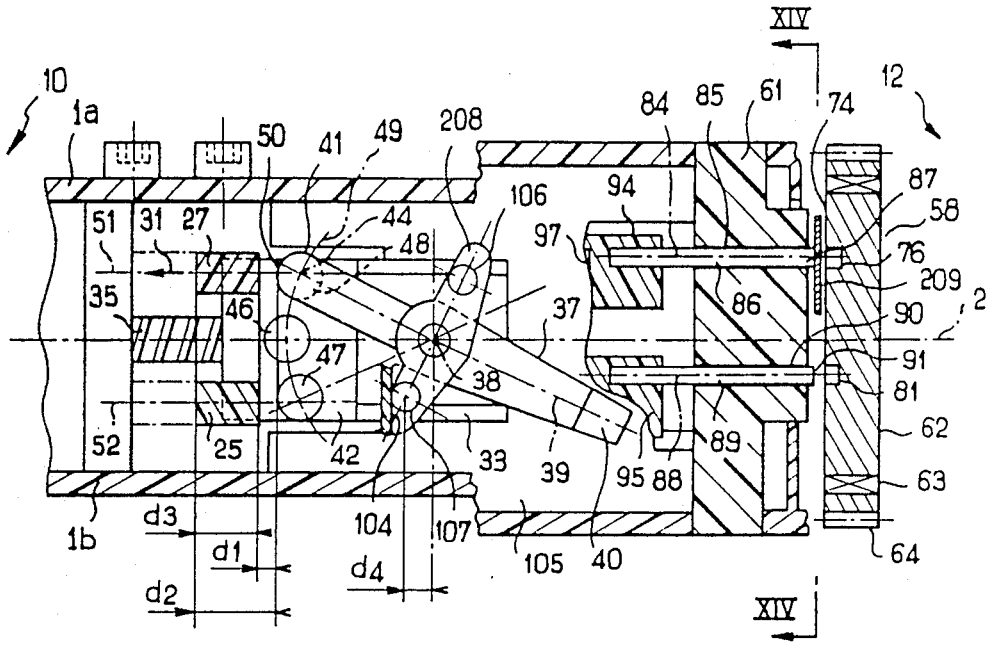
Figure 12:
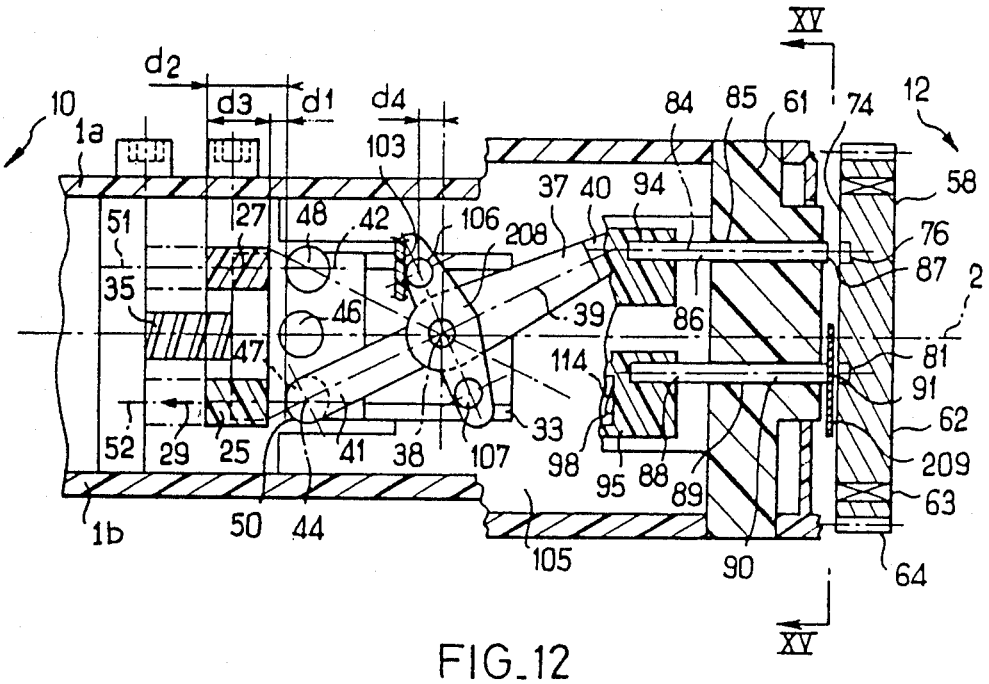
Figure 17:
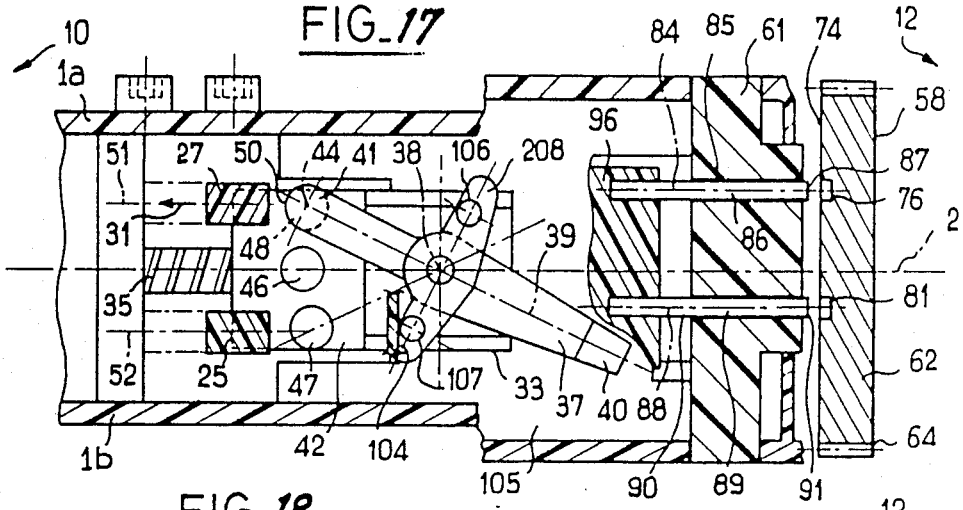
Figure 18:
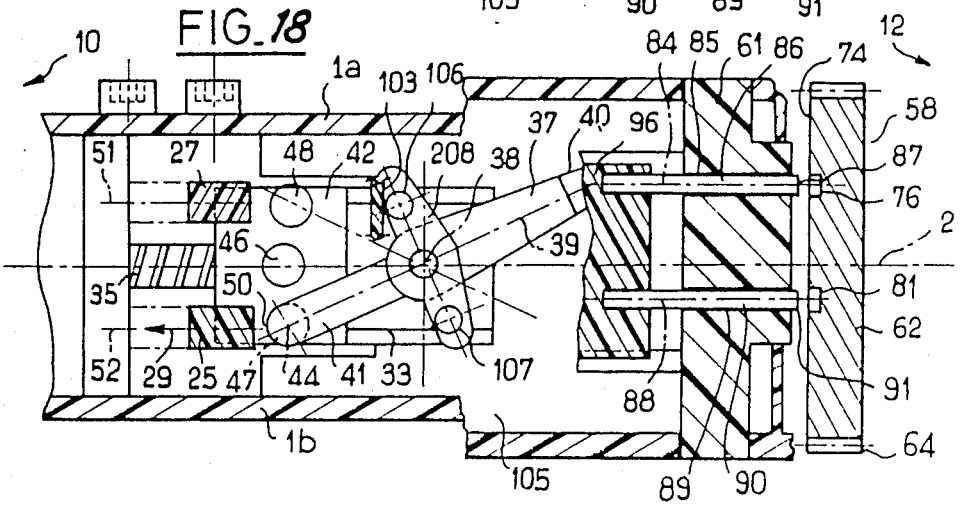

Thus by rotating the lever 37 about the axis 38 relative to the trigger 33 from the neutral position of the lever 37 when the trigger 33 occupies its maximum projection position the lever may be moved to two other positions, namely:

a position shown in FIGS. 5, 6, 11 and 17 in which the finger 43 is elastically inserted in the depression 48 and achieved by manually moving the part 40 of the lever 37 to the side of the plane 2 corresponding to the slider 25 and to the depression 47; in this position the part 41 of the lever 37 features towards the rear an end face 50 directly facing the slider 27 in a direction 51 parallel to the axis 5 and to the direction 34; if the trigger 33 is in its maximum projection position, the rear end face 50 of the part 41 is then located to the front of the slider 27, at a distance $d_1$ from the latter as measured in the direction 51; if the trigger 33 is moved to the maximum retracted position with the lever 37 in this position and immediately the trigger 33 has moved over a distance $d_2$ greater than $d_1$ in the direction 34, the rear end face 50 of the part 41 applies to the slider 27 the thrust 31 which moves the slider 27 into its position that makes an electrical connection between the terminals 17 and 23; this state is shown in FIG. 6; the travel $d_2$ of the trigger 33 between its maximum projection position and its maximum retraction position is chosen to coincide with the sum of the distance $d_1$ and the travel $d_3$ needed to move the slider 27 from its position making an electrical connection between the terminals 17 and 24 and its position making an electrical connection between the terminals 17 and 23; and a second position achieved by manually moving the part 40 to the side of the plane 2 corresponding to the slider 27 and in which the finger 43 is elastically inserted in the depression 47; in this position, shown in FIGS. 7, 8, 12 and 18, the rear end face 50 faces the slider 25 in a direction 52 parallel to the axis 5 and to the direction 34; if the trigger 33 is in its maximum projection position, which corresponds to the state shown in FIGS. 7, 12 and 18, the rear end face 50 of the part 41 of the lever 37 is then disposed to the front of the slider 25, at the distance $d_1$ defined hereinabove, so that the movement of the trigger 33 from its maximum projection position to its maximum retraction position over the travel $d_2$ defined hereinabove first causes the rear end face 50 of the part 41 to come into contact with the slider 25, after taking up the clearance $d_1$, and then to apply to the slider 25 the thrust 29 that displaces it to the position in which it makes an electrical connection between the terminal 16 and the terminal 21; the travel of the slider 25 to achieve this is equal to the travel $d_3$ previously defined; the state shown in FIG. 8 is thus achieved, corresponding to rotation of the output shaft 6 of the motor in the direction 30.

In both cases, releasing the trigger 33 when in its maximum retraction position permits elastic return of the trigger to its maximum projection position and elastic return of the slider 27 to its position making an electrical connection between the terminals 17 and 24 or of the slider 25 to its position making an electrical connection between the terminal 16 and 22.

Rotation of the output shaft 6 of the motor 4 in the direction 32 or in the direction 30, depending on whether the slider 25 or the slider 27 is displaced by the rear end face 50 of the part 41 of the lever 37 in turn displaced by the trigger 33, is transmitted by a step down gear train 53 disposed to the front of the motor 4 in the body 3 of the casing 1 to a tool-bearing spindle 54 which projects out of the body 3 of the casing 1 towards the front and which is rotatable relative to the casing 1 about an axis 55 fixed relative to the casing 1 and relative to the spindle 54 and parallel to the axis 5 in the plane 2; in a known way the spindle 54 is adapted to receive coaxially and removably a screwdriver blade 56; there is shown a spindle 54 receiving a blade 56 of this kind by snap-action means, but it is to be understood that this spindle 54 might be replaced by any similar device, such as a three-jaw chuck, for example.

To be more precise, the output shaft 6 of the motor 4 has fastened to it a gearwheel 57 which meshes constantly with a toothed wheel 58 disposed to rotate relative to the casing 1 about an axis 59 fixed relative to the casing 1 and relative to the toothed wheel 58, disposed parallel to the axis 5 in the plane 2; relative to the casing 1, this axis 59 is defined by a bearing 60 on a plate 61 fastened into the casing 1 generally perpendicularly to the axis 5 and by a bearing 161 situated to the front of the bearing 60 and defined by the casing itself; relative to the toothed wheel 58 the axis 59 is defined by a spindle 261 fastened to a hub part 62 of the toothed wheel 58, which hub part 62 itself carries, through the intermediary of known type centrifugal clutch means 63, a coaxial toothed ring 64 defining the meshing engagement between the wheel 58 and the gearwheel 57; the ring 64 constitutes the driving part of the centrifugal clutch 63 the driven part of which consists of the hub part 62 of the toothed wheel 58, so that when the output shaft 6 is immobile the clutch is released, so that rotation of the ring 64 relative to the hub part 62 about the axis 59 is possible, whereas rotation of the output shaft 6 in either direction 30 or 32 causes the toothed ring 64 and the hub part 62 to rotate together about the axis 59, that is to say the toothed wheel 58 to rotate about the axis 59 in the direction opposite to the direction in which the shaft 6 rotates.

The hub part 62 of the wheel 58 is fastened to a gearwheel 65 which meshes with a toothed wheel 66 rotatable relative to the casing 1 about an axis (not shown) parallel to the axes 5 and 59 and fixed relative to the casing 1 and relative to the toothed wheel 66; the toothed wheel 66 is fastened to a gearwheel 67 which meshes with teeth 68 on the spindle 54 the axis of rotation 55 of which is defined on one side of the teeth 68, that is to say towards the front, by a bearing 69 providing guidance for it where it passes through the casing 1 and towards the rear by a coupling by means of a coaxial shaft 70 to a bearing 71 of the plate 61.

Note that the hub part 62 of the toothed wheel 58, possibly together with the ring 64, and the spindle 54 are mutually coupled to rotate in the same direction, opposite the direction of rotation of the output shaft 6 of the motor 4 if such rotation of the spindle and the toothed wheel results from that of this output shaft; thus rotation of the output shaft 6 in the direction 30, as a result of appropriate supply of power to the motor 4, corresponds to rotation of the spindle 54 and of the toothed wheel 58 in an unscrewing direction 72 whereas rotation of the output shaft 6 in the direction 32 corresponds to rotation of the spindle 54 and of the toothed wheel 58 in the screwing direction 73.

For the purpose of implementing the present invention the hub part 62 of the toothed wheel 58 features a recess on an otherwise flat face 74 perpendicular to the axis 59 and facing towards the rear, that is to say towards the plate 61.

Figure 3:
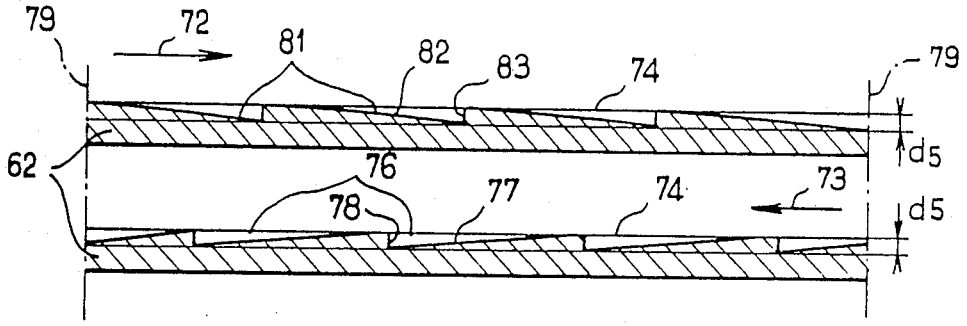
FIG. 3 shows the plane development of two coaxial cross-sections through this gearwheel.

To be more precise, the face 74 features on a first circle 75 with axis 59 a plurality of (four in this example) grooves 76 the shape of which is seen more clearly in FIG. 3 which shows the plane development of a cylindrical cross-section of the hub part 62 on the circle 75 relative to an arbitrarily chosen origin 79; FIG. 3 shows that in the direction along the grooves 76 around the circle 75 for the direction of rotation 73 of the hub part 62 corresponding to the screwing direction each of the grooves 76 has a flat bottom 77 flush with the face 74 at its upstream end and diverges from the face 74 in the direction towards its downstream end, by virtue of being progressively more deeply recessed into the hub part 62, and merges towards its downstream end with an end face 78 perpendicular to the face 74, to which the face 78 thus links the bottom 77; the grooves 76 are reproduced identically, regularly distributed around the circle 75.

Along a second circle 80 concentric with the circle 75 and nearer the axis 59 are regularly distributed identical grooves 81 the development of which along the circle 80 is shown in FIG. 3 from the same origin 79 as for the grooves 76; note that each of the grooves 81 has a flat bottom 82 inclined in the reverse way to the bottom 77 of the grooves 76; in other words, running around the circle 80 in the direction 72 corresponding to the unscrewing direction the bottom 82 of each groove 81 is flush towards the upstream end with the face 74 of the hub part 62 and is progressively more deeply recessed into the face 74 until it joins with a face 83 perpendicular to the face 74 to which the end face 83 of the groove 81 links the bottom 82 of the groove.

Along an axis 84 parallel to the axes 5 and 59 and intersecting the circle 75 there is a passage 85 extending completely through the member 61 and serving to guide sliding relative to the member 61 along the axis 84 of a rectilinear finger 86 which has dimensions transverse to the axis 84 less than the radial dimension of the grooves 76 relative to the axis 59, so that the finger 86 can have a front end 87 inserted into one or other of the grooves 76 and thus oppose rotation of the hub part 62 in the direction 72 by butting up against the end face 78 of the groove 76 in which it is inserted; the passage 85 and the finger 86 are offset relative to the plane 2 on the same side thereof as the depression 48 in the face 42 of the trigger 33 and the slider 27.

Similarly, along an axis 88 parallel to the axes 5 and 59, intersecting the circle 80 and disposed on the other side of the plane 2 relative to the axis 84, advantageously defining with this axis a plane perpendicular to the plane 2, is a second rectilinear passage 89 passing right through the member 61 and serving to guide sliding relative to this member along the axis 88 of a rectilinear finger 90 having dimensions transverse to the axis 88 less than the radial dimension of each groove 81 relative to the axis 59, so that the front end 91 of the finger 90 can enter any groove 81 and, by butting up against the end face 83 of that groove, oppose rotation of the hub part 62 in the direction 73; the plane in which in their axes 84 and 88 both lie is disposed so that the axes 5 and 59 are situated on the same side of this plane.

Note, however, that the finger 86 never opposes rotation of the hub part 62 in the direction 73 and that the finger 90 never opposes rotation of the hub part 62 in the direction 72; should the two fingers be inserted simultaneously into the respective grooves they oppose any rotation of the hub part 62.

Figure 15:
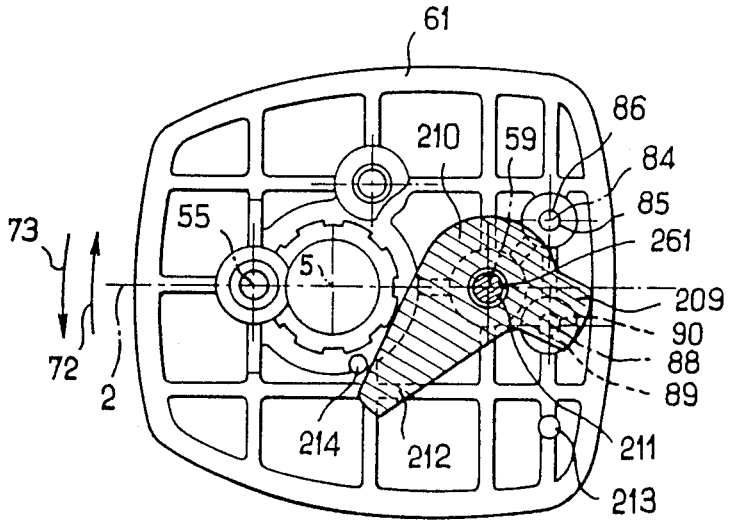
Figure 16:
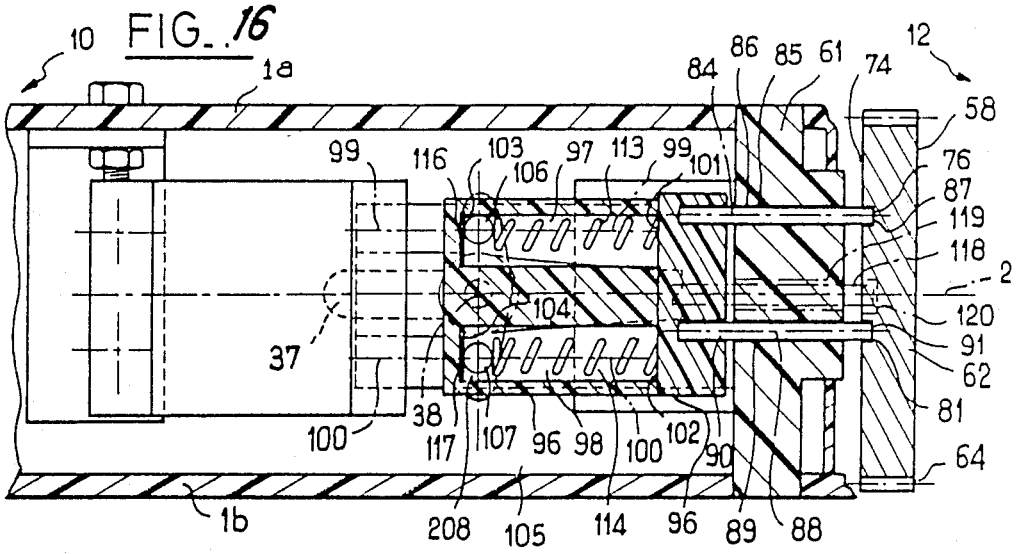
FIGS. 16 through 18 show three respective states of a further embodiment of motorized screwdriver in accordance with the invention, being views in cross-section analogous to those of FIGS. 4, 5 and 7, respectively.

To the rear of the plate 61 each of the fingers 86 and 90 has a respective rear end 92, 93 embedded in and fastned to a respective slide 94, 95, in the case of the embodiments shown in FIGS. 1 through 15, or in a single slide 96 in the case of the simplified embodiment shown in FIGS. 16 through 18; the substitution of a single slide 96 for the two separate slides 94, 95 and the implementation of the hub part 62 and the ring 64 of the toothed wheel 58 as a single member, with no centrifugal clutch means between them, are the only structural differences between the embodiment of FIGS. 16 through 18 and the embodiment of FIGS. 1 through 9; consequently, some components shown in FIGS. 1 through 9 also appear in FIGS. 16 through 18, identically and with the same reference numbers.

Each of the slides 94 and 95 is situated on the same side of the plane 2 as the respective associated latching finger 86 and 90, whereas the slide 96 straddles the plane 2.

Each of the slides 94 and 95, or each part of the slide 96 respectively situated to the same side of the plane 2 as the finger 86 and the finger 90, features a respective groove 97, 98 with respective axes 99, 100 parallel to the axis 5; note that the grooves 97 and 98 are identical and that their respective axes 99 and 100 are disposed symmetrically to each other relative the plane 2.

Towards the front each of the grooves 97 and 98 is delimited by a respective flat face 101 perpendicular to the axis 99 and 102 perpendicular to the axis 100; similarly, towards the rear each of the groove 97 and 98 is closed off by a respective flat face 103 and 104 perpendicular to the respective axis, the distance between the faces 101 and 103 along the axis 99 being exactly the same as the distance between the faces 102 and 104 along the axis 100.

The grooves 97 and 98 are closed off transversely to their respective axes except where they face a flat wall 105 of the body 3 of the casing 1, which wall 105 is perpendicular to the plane 2, parallel to the axis 5 and flanked within the body 3 of the casing 1 by the two slides 94 and 95 or by the single slide 96 and outside the body 3 by the rotation direction selector lever 37.

The grooves 97 and 98 are entirely open in the direction towards this wall 105 so that each of them can receive inside it a respective stud 106, 107 carried by and fastened to a rocking lever member 208 disposed inside the body 3 of the casing 1 and coupled to the lever 37 through a slot 45 in the wall 105.

Figure 10:
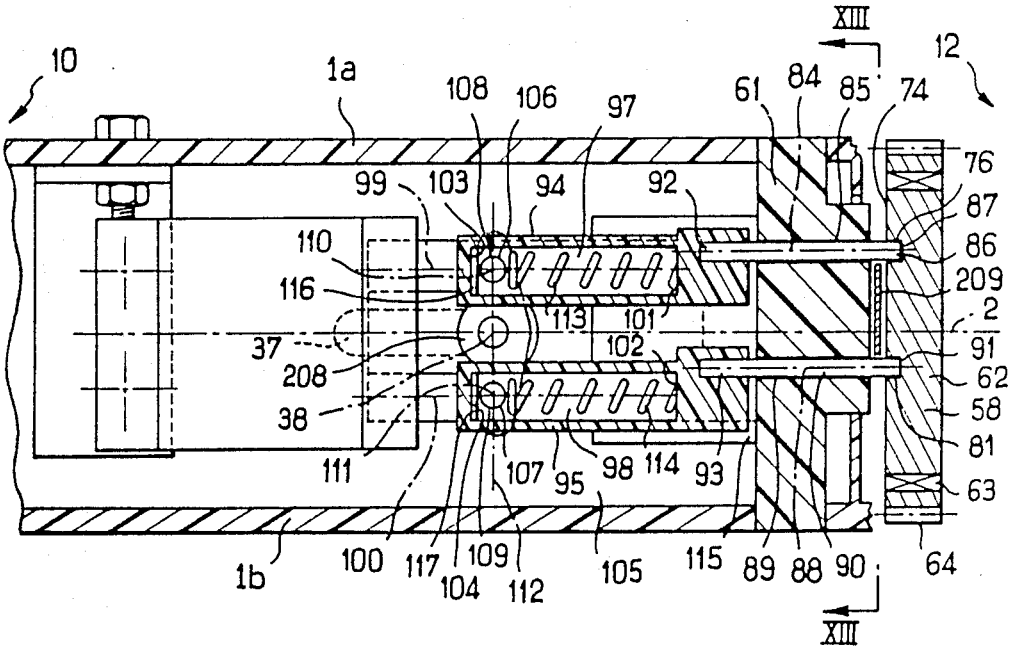
FIGS. 10 through 12 show three respective states of an alternative embodiment of motorized screwdriver in accordance with the invention, being views in cross-section analogous to those of FIGS. 4, 5 and 7, respectively.

To simplify the description reference will now be made to a state as shown in FIGS. 4, 10 and 16 in which the specific mean direction 39 of the lever 37 is situated in the plane 2 and in which the trigger 33 occupies its maximum projection position; the studs 106 and 107 are diposed symmetrically to each other relative to the plane 2 and are of precisely the same shape, characterized in particular by a cylindrical surface of revolution 108, 109 about a respective axis 110, 111 parallel to the axis 38, relative to which the two axes 110 and 111 are disposed symmetrically to each other; thus in the position showin in FIGS. 4 and 10 the axes 110 and 111 are disposed symmetrically to each other relative to the plane 2, in a plane 112 perpendicular to the plane 2.

Inside each groove 97, 98 is a respective helical compression spring 113, 114 diposed between the respective stud 106, 107 and the respective forward end face 101, 102 of the groove so as to urge the corresponding slide 94 or 95, or the single slide 96 replacing the two slides 94 and 95, elastically towards the front; in the position shown in FIGS. 4 and 10, this causes the respective forward ends 87 and 91 of the latching fingers 86 and 90 to enter respectively a groove 76 and a groove 81, while there remains between the slides 94 and 95 (or the slide 96, on the one hand, and the member 61, on the other hand) a clearance 115 adapted to permit access of the ends 87 and 91 of the fingers 86 and 90 to the full depth of the grooves 76 and 81 and so that there remain between the stud 106 and the face 103 of the groove 97 and between the stud 107 and the face 104 of the groove 98 respective clearances 116 and 117, also sufficient to this purpose. The clearances 115, 116, 117 are maintained at the minimum possible value at all times by the action of the springs 113 and 114.

Parallel to the axes 110 and 111, the clearances 116 and 117 have a maximum dimension limited to a value less than the value $d_4$ of the longitudinal component, that is to say the component parallel to the axis 5, of the travel of each of the studs 106 and 107 caused by rotation about the axis 38, when the lever 37 is moved from its position with the finger 43 elastically latched in the depression 46 to one or other of its positions with the finger 43 latched into the depressions 47 and 48, respectively, reduced by the value of the travel that has to be applied along the axes 84 and 88 to disengage completely from the grooves 76 and 81 the respective forward ends 87 and 91 of the fingers 86 and 90, even if the latter are engaged to the maximum possible extent in the grooves, that is to say in contact with the respective bottoms 77 and 82 thereof in the immediate vicinity of the respective end faces 78 and 83; in other words, if $d_5$ designates the maximum depth of the grooves 76 and 71, assumed to be identical, measured perpendicularly to the face 74, then the maximum value of the clearances 116 and 117 when the lever 37 and trigger 33 occupy their positions shown in FIGS. 4 and 10 must be less than $d_4$ minus $d_5$.

It is also preferable for the value of $d_2$ to be greater than the sum of $d_4$, $d_5$ and the maximum value of the clearances 116 and 117 measured parallel to the axes 110 and 111 when the lever 37 and the trigger 33 occupy their positions shown in FIGS. 4 and 10.

The screwdriver in accordance with the invention as just described functions in the following manner.

Referring firstly to the embodiment shown in FIGS. 1 through 9, and considering as an initial state that shown in FIG. 4:

in this initial state, in which the specific mean direction 39 of the lever 37 lies in the plane 2 and in which the trigger 33 occupies its position of maximum projection from the butt 7 of the casing 1, the sliders 25 and 27 are not subject to any thrust 29 or 31 and, because of the action of the springs 26 and 28, occupy a position such that the two terminals 16 and 17 of the motor 4 are respectively connected to the terminals 22 and 24, that is to say to the positive terminal 15 of the electric batteries 8, so that the output shaft 6 of the motor is immobilized against rotation in either direction about the axis 5; the centrifugal clutch 63 is released and the respective forward ends 87 and 91 of the fingers 86 and 90 are respectively applied by the springs 113 and 114 against the bottom 77 of one groove 76 and against the bottom 82 of one groove 81 so that the fingers 86 and 90, in this way able to abutt respectively against the end face 78 of the groove 76 and against the end face 73 of the groove 81, respectively prevent rotation of the hub part 62 of the toothed wheel 58 and of the spindle 54 in the screwing direction 73 and in the unscrewing direction 72;

if the user operates on the part 40 of the lever 37 so as to move the latter into the position shown in FIG. 5, with the finger 43 latched into the depression 48 of the trigger 33 with the latter remaining in its maximum projection position, the end face 50 of the part 41 of the lever 37 is disposed facing the slider 27, at the distance $d_1$ from the latter, and the stud 107 situated on the opposite side to the slider 27 relative to the plane 2 comes into contact with the end face 104 of the groove 98 and thus applies to the slide 95 and to the finger 90 a longitudinal translation towards the rear, with an amplitude equal to $d_4$ minus the initial longitudinal size of the clearance 117, which is sufficient to disengage the end 91 of the finger 90 from the groove 81; given the shape of the grooves 76, one of which, because of the action of the spring 113, still contains the forward end 87 of the finger 86, there is no longer anything to prevent rotation of the hub part 62 of the wheel 58 and of the spindle 54 in the screwing direction 73; on the other hand, rotation in the opposite direction 72 is prevented but the elastic nature of the loading of the finger 86 in the direction of insertion in a groove 76 makes the screwdriver usable as a ratchet type manual screwdriver in the screwing direction;

if the user then depresses the trigger 33 into its maximum retraction position, causing it to move over the travel $d_2$, the rear end face 50 of the part 41 of the lever 37 comes into contact with the slider 27 and then pushes this back to the position in which it electrically connects the terminals 17 and 23, as shown in FIG. 6; the motor 4 is then supplied with power in such a way that its output shaft 6 rotates in the direction 32, which engages the centrifugal clutch 63 and results in the hub part 62 of the toothed wheel 58 and the spindle 54 being driven in the screwing direction 73; during an intermediate phase in which the trigger 33 moves from its maximum projection position to its maximum retraction position the stud 106 comes into contact with the end face 103 of the groove 97 and then, before the motor starts, causes disengagement of the finger 86 from the groove 76, which prevents any contact between the finger 86 and the hub part 62 during rotation of the latter, so preventing any wear of these members;

when the user subsequently releases his pressure on the trigger 33 to allow it to return to its maximum projection position, the slider 27 is initially returned to its position electrically connecting the terminals 17 and 24, which stops the motor 4 by short-circuiting it; the centrifugal clutch 63 then releases the hub part 62 relative to the ring 64 and the forward end 87 of the finger 86 is again inserted in a groove 76; this returns to the state shown in FIG. 5, in which the finger 90 is not inserted in a groove 81, which permits use of the screwdriver as a ratchet type manual screwdriver; note that because of the releasing of the centrifugal clutch 63 relative rotation of the screwdiver and the spindle in the direction then authorized does not result in any rotation of the motor 4, with the result that the latter does not produce any opposing torque;

by turning the lever 37 the user can return the screwdriver to the state shown in FIG. 4, with the spindle totally immobilized against rotation;

the user can then move the lever 37 to the position shown in FIG. 7, in which the finger 43 is elastically latched in the recess 47 in the top face 42 of the trigger 33, which is in its maximum projection position, which releases the finger 87 from the groove 76 and leaves the finger 90 in a groove 81, the result of which is to permit use of the screwdriver as a ratchet type manual screwdriver in the unscrewing direction; the rear end face 50 of the part 41 of the lever 40 is then disposed opposite the slider 25 which is in the position electrically connecting the terminals 16 and 22, meaning that the motor 4 is short-circuited, that is to say stopped;

the user then moves the trigger 33 to the maximum retraction position, which successively brings about extraction of the finger 90 from the groove 81 and supply of power to themotor 4 through the intermediary of the slider 25 in such a way that the output shaft 6 turns in the direction 30 corresponding to unscrewing; the centrifugal clutch 63 then causes the parts 62 and 64 of the toothed wheel 58 to rotate together and drives the toothed wheel 58 and the spindle 54 in the unscrewing direction 72; this state is shown in FIG. 8;

releasing the trigger 33 so that it resumes its maximum projection position causes the slider 25 to return to its position short-circuiting the motor 4, which then stops so that the clutch 63 decouples the parts 62 and 64 of the toothed wheel 58 so that they are no longer constrained to rotate together, and then the finger 90 is again inserted into a groove 81, as shown in FIG. 7, although the finger 86 remains free of the grooves 76; thus the screwdriver can again be used as a ratchet type manual screwdriver;

the user can then turn the lever 37 to the position shown in FIG. 4, immobilizing the spindle against rotation in either direction.

The screwdriver of the improved embodiment shown in FIGS. 10 through 15 differs from the screwdriver described with reference to FIGS. 1 through 9 only in terms of additional provisions; thus the component parts already described with reference to FIGS. 1 through 9 are shown again in FIGS. 10 through 15, identically and with the same reference numbers.

Figure 13:
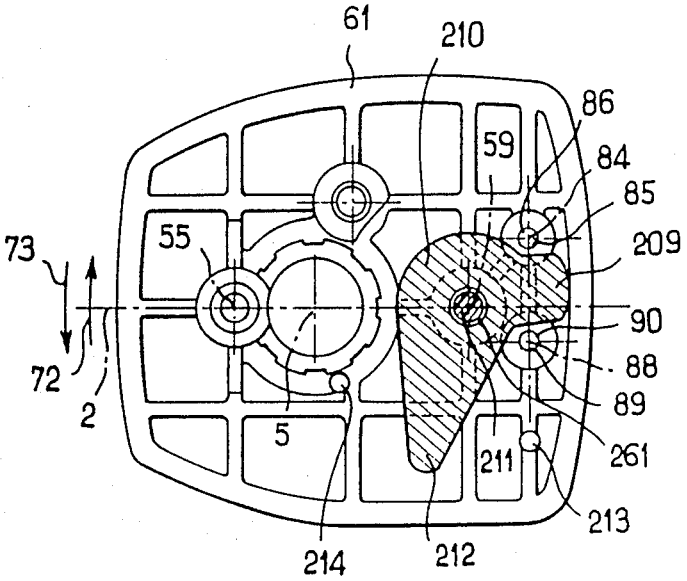
FIGS. 13 through 15 are partial views in cross-section perpendicular to the axis of rotation of the spindle on the lines XIII—XIII in FIG. 10, XIV—XIV in FIG. 11 and XV—XV in FIG. 12, respectively.
Figure 14:
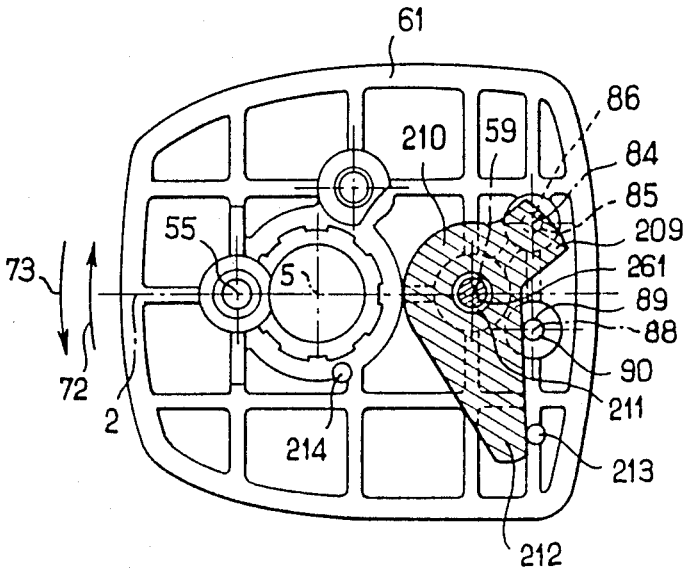

The embodiment shown in FIGS. 10 through 15 comprises inhibitor means in the form of a small plate 209 lying against the face 74 of the hub part 62 of the toothed wheel 58 so as to be disposed between the finger 86 and the grooves 76 when the hub part 62 of the toothed wheel 58 turns in the direction 73, but so as to allow the finger 90 to move towards the grooves 81, as shown in FIGS. 11 and 14, and so as to be disposed between the finger 90 and the grooves 81 when the hub part 62 of the toothed wheel 58 turns in the direction 72, without at this stage providing any obstacle between the finger 86 and the grooves 76, as shown in FIGS. 12 and 15; the angular extent of the plate 209 relative to the axis 59 is less than the angular distance between the fingers 86 and 90, or between the passages 85 and 89; the plate 209 can occupy a position in which it is interpolated between the respective alignments of these passages so as to simultaneously allow access of the finger 86 to the grooves 76 and of the finger 90 to the grooves 81; this third position of the plate 209 is shown in FIGS. 10 and 13.

To this end, in a particularly simple manner most clearly seen in FIGS. 13 through 15, the plate 209 constitutes a flat appendix perpendicular to the axis 59 of a flat member 210 also perpendicular to the axis 59; the member 210 is rotatable relative to the body 3 about the same axis 59 as the toothed wheel 58; to be more precise, the member 210 has along the axis 59 a bore 211 which is cylinder of revolution about the axis 59 with a diameter substantially equal to that of the spindle 261 fastened to the hub part 62 of the wheel 58 and serving to guide the latter for rotation about the axis 59 relative to the casing 1; this diameter and the material of which the member 210 is made are chosen so that the bore 211 serves to procure frictional interlocking of the member 210 and spindle 261, specifically in connection with rotation about the axis 59, which also procures frictional interlocking for such rotation between the hub part 62 of the toothed wheel 58 and the plate 209.

This interlocking is obtained only if there is no obstacle to rotation of the member 210 relative to the casing 1 and the two positions of the plate 209 respectively shown in FIGS. 11 and 12 are defined by stop means limiting rotation of the member 210 and thus of the plate 209 in both directions.

In the embodiment shown these stop means comprise on the member 210 a second appendix 212 offset circumferentially to the plate 209 relative to the axis 59 in such a way that it is never disposed opposite the bore 85 or the bore 89 whatever the angular position of the member 210 within the limits authorised by the stop means; the stop means further comprise two stop studs 213 and 214 fastened to the support plate 61 and forming a projection towards the toothed wheel 58, on the path that the appendix 212 is constrained to take on conjoint rotation of the member 210 and the hub part 62 of the toothed wheel 58, without actually reaching the toothed wheel 58, the two studs 213, 214 lying on the same side of the plane 2; the apendix 212 of the member 210 is disposed between the two studs 213 and 214; relative to the axis 59, the respective angular positions of the studs 213 and 214, the angular position of the appendix 212 relative to the plate 209 and the angular sizes of the plate 209 and the appendix 212 are chosen, in a way that will be obvious to those skilled in the art, so that when the hub part 62 turns in the direction 72 and entrains the member 210 in the same direction until the appendix 212 comes into abutting engagement with the stud 214, in a position in which the plate 209 lies opposite the passage 89 in the plate 61 to form an obstacle for the finger 90 as shown in FIGS. 12 and 15, conjoint rotation of the member 210 and the hub part 62 of the toothed wheel 58 in the direction 73 causes the appendix 212 of the member 210 to butt up against the stud 213, which stops the member 210 in a position in which the plate 209 is opposite the passage 85 to constitute an obstacle the finger 86 as shown in FIGS. 11 and 14, and so that it is possible to rotate the spindle 55 by hand to move the member 210 into an intermediate position, shown in FIGS. 10 and 13, in which the appendix 212 is approximately half-way circumferentially between the two studs 213 and 214 and in which the plate 209 is situated circumferentially between the alignments of the two passages 85 and 89 to allow access of the two fingers 86 and 90 to the grooves 76 and 81, when the motor 4 is stopped, of course.

There will now be described how the screwdriver of the embodiment shown in FIGS. 10 through 15 functions, taking as the initial state that shown in FIGS. 10 and 13, identical to the state shown in FIG. 3 except that the plate 209 is disposed between the two fingers 86 and 90, respectively engaged in the grooves 76 and 81.

If the lever 37 is moved from this initial state into its position that preselects the screwing direction 73 when the trigger 33 is released and the trigger 33 is then pressed so as to operate the slider 27, the phenomena described above with reference to FIGS. 5 and 6 occur in precisely the same way and the member 210 is entrained in the direction 73, by friction, together with the hub part 62 of the toothed wheel 58, until it reaches its stop position with the appendix 212 against the stud 213, so that the plate 209 is placed between the passage 85, into which the finger 86 is retracted, and the grooves 76 as shown in FIG. 14; if the trigger 33 is then released the screwdriver assumes the state shown in FIGS. 11 and 14, identical to the state described with reference to FIG. 5 except that the finger 86, acted on by the spring 113, butts up against the plate 209 which prevents it being inserted again into a groove 76; given the assumption that the hub part 62 of the wheel 58 is not yet stopped, this prevents wear of the end 87 of the finger 86 by rubbing against the bottom 77 of the grooves 76 and repeated impacts of this end 87 against the bottom 77 of the grooves 76 on passing over the end faces 78; to use the screwdriver as a ratchet type manual screwdriver, the plate 209 is then retracted by turning the spindle by hand in the direction 72; immediately the plate 209 releases the finger 86 the latter is pushed by the spring 113 into the groove 76, which is immediately opposite it, returning the screwdriver to the state shown in FIG. 5; this use as a ratchet type manual screwdriver in the screwing direction naturally presupposes that the lever 37 is left in the position preselecting the screwing direction 73; if the lever 37 is then returned to its neutral position the plate 209 may possibly be situated facing the passage 89 and so constitute an obstacle to returning the end 91 of the finger 90 to a groove 81, but manual rotation of the spindle 54 in the direction 72 makes it possible to return the member 210 by friction to a position in which the plate 209 bears against the finger 86, that is to say a position intermediate the respective positions of the passages 85 and 89, which makes it possible for the spring 114 to again press the finger 90 into a groove 81; the state of the screwdriver is then as shown in FIGS. 10 and 13.

If the lever 37 is then moved to a position preselecting the unscrewing direction 72 and the trigger 33 is pressed to depress the slider 25, the output shaft 6 of the motor 4 is caused to rotate in a direction 30 conjointly with rotation of the toothed wheel 58 and of the spindle 54 in the direction 72, bringing about in succession the states respectively described with reference to FIG. 7 and with reference to FIG. 8; the member 210 is entrained by friction in the direction 72 until its appendix 212 butts up against the stud 214, as shown in FIG. 15, which places the plate 209 between the finger 90, retracted into the passage 89 at this time, and the grooves 81; if the trigger 33 is then released with the lever 37 remaining in the position preselecting the unscrewing direction 72, the fingers 86 and 90 tend to return to the position shown in FIG. 7, except that the finger 90 butts up against the plate 209, as shown in FIG. 12; this avoids contact between the end 91 of the finger 90 and hub part 62 of the toothed wheel 58 which may still be rotating at this time; to use the screwdriver as a ratchet type manual screwdriver for the unscrewing direction, the spindle 54 is rotated by hand in the direction 73, which also causes rotation of the member 210 in the direction 73, for example until an abutting relationship is established between the appendix 212 and the stud 213, which exposes the passage 89 and allows the spring 114 to push the finger 90 until the end 91 of the finger contacts the bottom of a groove 81; the state of the screwdriver is then that described with reference to FIG. 7; the screwdriver may be returned to the state shown in FIG. 10 by rotating the spindle 54 by hand in the direction 72 so as to move the plate 209 into an angular position between the alignments of the two passages 85 and 89, butted up against the finger 90, for example, and then returning the lever 37 to its neutral position.

Note that the various manual rotations to be imparted to the spindle to retract the plate 209 may be achieved by a natural gesture of the user, without interrupting the contact between the screwdriver blade 56 and the screw (not shown), involving appropriate manual rotation of the casing 1 about the axis 55 relative to the spindle 54 of the blade 56, through a few degrees.

The functioning of the simplified embodiment shown in FIGS. 16 through 18 may readily be deduced from that described with reference to FIGS. 1 through 9; the state shown in FIG. 16 corresponds in all respects to that shown in FIG. 4; however, the movement of the lever 37 to the position with the finger 43 interlocked with the depression 48 in the upper face 42 as shown in FIG. 17 or to the position with the finger 43 interlocked with the depression 47 in this face, as shown in FIG. 18, with the trigger 33 in its maximum projection position releases the spindle 54 to rotate in either direction, with no possibility of using the screwdriver as a ratchet type screwdriver; immediately the position shown in FIG. 17 or the position shown in FIG. 18 is reached, pressing the trigger 33 to move it to its maximum retraction position merely starts the motor 4 so that its output shaft 6 turns in the respective direction 32 or 30, which drives the toothed wheel 58 and the spindle 54 in the respective direction 73 or the direction 72; if the trigger 33 is then released to return to its maximum projection position the motor is stopped by virtue of the short-circuiting of its terminals 16 and 17; rotation of the lever 37 until its specific mean direction 39 again lies in the plane 2 simultaneously returns the two fingers 86 and 90 into the respective grooves 76 and 81, once again immobilizing the spindle 54 against rotation in either direction and enabling the screwdriver to be used as an ordinary screwdriver.

Note that the embodiment of the screwdriver shown in FIGS. 16 through 18 could be even further simplified as shown in chain-dotted line in FIG. 16; in this embodiment the fingers 86 and 90 and the passages 85 and 89 to accommodate them in the member 61 are eliminated, as are the grooves 76 and 81; on the other hand, a blind hole 120 offset relative to the axis 59 is formed on the face 74 of the toothed wheel 58; in line with the path that this blind hole 120 is constrained to follow on rotation of the toothed wheel 58 about the axis 59 is a passage 119 extending completely through the member 61, in a direction parallel to the axis 5 and lying in the plane 2; like the passages 85 and 89 previously described, the passage 119 serves to guide coaxial sliding relative to the member 61 of a single finger 118 in all respects comparable with and replacing the fingers 86 and 90 previously described and carried and fastened to the slide 96, which like the other components of the screwdriver may remain unchanged; this embodiment functions in the same way as the screwdriver shown in FIGS. 16 and 18, except that instead of simultaneously inserting the fingers 86 and 90 into the grooves 76 and 81 on changing from the position shown in FIG. 16 to the position shown in FIG. 17 or to the position shown in FIG. 18, the finger 118 is released from the blind hole 120; on returning to the position shown in FIG. 16, the finger 118 is inserted into the blind hole 120 in substitution for insertion of the fingers 86 and 90 into the grooves 76 and 81.

Those skilled in the art may readily conceive numerous other embodiments of the screwdriver as just described without departing from the scope of the present invention.

We claim:

1. Portable motorized screwdriver, comprising:

a tool casing;

a tool-bearing spindle rotatably mounted in said tool casing;

drive mean adapted to rotate said spindle in respective opposite directions;

manual switching means adapted to cause said drive means selectively to rotate said spindle in one or other of said respective opposite directions or to stop said drive means;

locking means adapted to enable or prevent rotation of said spindle relative to said tool casing, said locking means being coupled to said manual switching means in such a way that actuation of said manual switching means to cause said drive means to rotate said spindle in one or other of said respective opposite directions causes said locking means to enable rotation of said spindle relative to said tool casing at least in said one or other of said respective opposite directions;

said manual switching means being adapted to authorize pre-selection of one or other of said respective opposite directions when said drive means are stopped; and said locking means being coupled to said manual switching means in such a way that actuating said manual switching means to stop said drive means with a first of said respective opposite directions pre-selected causes said locking means to lock said spindle against rotation relative to said tool casing in the second of said respective opposite directions and to enable rotation of said sindle relative to said tool casing in said first direction, and actuating said manual switching means to stop said drive means with the second of said respective opposite directions pre-selected causes said locking means to lock said spindle against rotation relative to said tool casing in the first of said respective opposite directions and to enable rotation of said spindle relative to said tool casing in said second direction.

2. Motorized screwdriver according to claim 1, wherein said manual switching means comprise a trigger and a trigger-operated switch, and said locking means are mechanically coupled to said trigger in such a way that actuating said trigger to operate said drive means causes said locking means to release said spindle to allow rotation of said spindle relative to said tool casing.

3. Motorized screwdriver according to claim 1, wherein said drive means comprise a motor and a transmission system coupling said motor to said spindle, said manual switching means comprise means for starting and stopping said motor, said transmission system comprises clutch means that are engaged when said motor is running and disengaged when said motor is stopped, and said locking means cooperate with said transmission system on the output side of said clutch means.

4. Motorized screwdriver according to claim 3, wherein said clutch means comprise a centrifugal clutch having a driven part coupled to said motor and a driving part coupled to said spindle.

5. Motorized screwdriver according to claim 1, comprising time-delay means for delaying locking of said spindle relative to stopping of said drive means and for delaying starting of said drive means relative to releasing of said spindle.

6. Motorized screwdriver according to claim 1, wherein said drive means comprise a direct current electric motor having first and second power supply terminals and said manual switching means comprise means for connecting said first and second terminals of said motor respectively to first and second terminals of a direct current power supply in order to operate said drive means so as to rotate said spindle in one of said respective opposite directions and means for connecting said first and second terminals of said motor respectively to said second and first terminals of said power supply in order to operate said drive means so as to rotate said spindle in the other of said respective opposite directions, said manual switching means comprising means for connecting said first and second terminals of said motor together and isolating them from at least one of said terminals of said power supply in order to stop said drive means.

7. Portable motorized screwdriver, comprising:

a tool casing;

a tool-bearing spindle rotatably mounted in said tool casing;

drive means adapted to rotate said spindle in respective opposite directions;

manual switching means adapted to cause said drive means selectively to rotate said spindle in one or other of said respective opposite directions or to stop said drive means; and locking means, operative between said tool casing and said spindle, for enabling or preventing rotation of said spindle relative to said tool casing, said locking means being coupled to said manual switching means in such a way that actuation of said manual switching means to cause said drive means to rotate said spindle in one or other of said respective opposite directions causes said locking means to enable rotation of said spindle at least in said one or other of said respective opposite directions;

said manual switching means being adapted to authorize pre-selection of one or other of said respective opposite directions when said drive means are stopped;

said locking means being coupled to said manual switching means in such a way that actuating said manual switching means to stop said drive means with a first of said respective opposite directions pre-selected causes said locking means to lock rotation of said spindle relative to said tool casing in the second of said respective opposite directions and to enable rotation of said spindle relative to said tool casing in said first direction;

said drive means comprising a motor, and a transmission system coupling said motor to said spindle and comprising at least one rotatable member rotationally coupled to said spindle;

said locking means comprising at least two locking fingers movable between respective first and second positions, first abutment means, and second abutment means;

said first abutment means being fastened to said at least one rotatable member and adapted to abutt against a first of said at least two fingers in its first position for rotation of said at least one rotatable member in a first direction associated with the first rotation direction of said spindle, to remain free of said first finger in its first position for a second direction of rotation of said at least one rotatable member opposite to its first direction of rotation, and to remain free of said first finger in its second position for both directions of rotation of said at least one rotatable member;

said second abutment means being fastened to said at least one rotatable member and adapted to abutt against a second of said at least two fingers in its first position for said second direction of rotation of said at least one rotatable member, to remain free of said second finger in its first position for said first direction of rotation of said at least one rotatable member, and to remain free of said second finger in its second position for both directions of rotation of said at least one rotatable member; and said locking fingers being coupled to said manual switching means in such a way that:

said first locking finger assumes its first position when said manual switching means are actuated to stop said drive means and said second direction of rotation of said spindle is preselected, said second locking finger assumes its first position when said manual switching means are actuated to stop said drive means and said first direction of rotation of said spindle is preselected, and said first and second locking fingers assume their respective second positions when said manual switching means are actuated to cause said drive means to rotate said spindle in said first or said second direction.

8. Motorized screwdriver according to claim 7, wherein said manual switching means comprise a trigger and a trigger-operated switch and said locking means are mechanically coupled to said trigger in such a way that actuating said trigger to operate said drive means causes said locking means to release said spindle.

9. Motorized screwdriver according to claim 7, wherein said locking means comprise spring means adapted to urge each of said at least two locking fingers towards its respective first position and said at least two locking fingers are coupled to said manual switching means in such a way that:

said first locking finger assumes its first position as a result of the action on it of said spring means when said manual switching means are actuated to stop said drive means and said second direction of rotation of said spindle is preselected.

said second locking finger assumes its first position as a result of the action on it of said spring means when said manual switching means are actuated to stop said drive means and said first direction of rotation of said spindle is preselected, said first and second locking fingers assume their respective second position when said manual switching means are actuated to cause said drive means to rotate said spindle in said first or second direction.

10. Motorized screwdriver according to claim 9, further comprising an inhibitor member adapted to be disposed between said first finger and said first abutment means when said at least one rotatable member rotates in said second direction, to be disposed between said second finger and said second abutment means when said at least one rotatable member rotates in said first direction, and to be retracted after said manual switching means have been actuated to stop said drive means to prevent contact between said fingers and said abutment means until said drive means have stopped.

11. Motorized screwdriver according to claim 9, further comprising an inhibitor member adapted to be disposed between said first finger and said first abutment means when said at least one rotatable member rotates in said second direction, to be disposed between said second finger and said second abutment means when said at least one rotatble member rotates in said first direction, and to be retracted after said manual switching means have been actuated to stop said drive means to prevent contact between said fingers and said abutment means until said drive means have stopped, wherein said inhibitor member comprises at least one plate associated with said at least one rotatable member and driven coaxially with it and in the same direction as it by friction, further comprising stop means adapted to limit rotation of said at least one plate in said first and second directions of rotation of said at least one rotatable member respectively to an angular position in which said plate is disposed between said second finger and said second abutment means and not disposed between said first finger and said first abutment means and an angular position in which said plate is disposed between said first finger and said first abutment means and not disposed between said second finger and said second abutment means.

12. Motorized screwdriver according to claim 11, wherein said at least two fingers are mutually offset in the circumferential direction with a specific circumferential spacing between them and said plate has a circumferential dimension less than said circumferential spacing.

13. Motorized screwdriver according to claim 7, wherein said drive means comprise a motor and a transmission system coupling said motor to said spindle, said manual switching means comprise means for starting and stopping said motor, said transmission system comprises clutch means that are engaged when said motor is running and disengaged when said motor is stopped, and said locking means cooperate with said transmission system on the output side of said clutch means.

14. Motorized screwdriver according to claim 13, wherein said clutch means comprise a centrifugal clutch having a driven part coupled to said motor and a driving part coupled to said spindle.

15. Motorized screwdriver according to claim 7, comprising time-delay means for delaying locking of said spindle relative to stopping of said drive means and for delaying starting of said drive means relative to releasing of said spindle.

16. Motorized screwdriver according to claim 13, wherein said drive means comprise a direct current electric motor having first and second power supply terminals and said manual switching means comprise means for connecting said first and second terminals of said motor respectively to first and second terminals of a direct current power supply in order to operate said drive means so as to rotate said spindle in one of said respective opposite directions and means for connecting said first and second terminals of said motor respectively to said second and first terminals of said power supply in order to operate said drive means so as to rotate said spindle in the other of said respective opposite directions, said manual switching means comprising means for connecting said first and second terminals of said motor together and isolating them from at least one of said terminals of said power supply in order to stop said drive means.

17. A hand-held power screwdriver, comprising:

a casing;

a motor supported by said casing;

an output spindle rotatably mounted in said casing for rotation by said motor in a forward direction for screwing-in screws and a reverse direction for unscrewing screws;

a manually actuatable switch for selecting the direction for rotation of said spindle by said motor;

means, connected between said casing and said spindle, for locking said spindle relative to said casing to prevent rotation of said spindle relative to said casing in said reverse direction but at the same time to allow rotation of said spindle relative to said casing in said forward direction when said switch is positioned to select the forward direction for rotation of said spindle and said motor is not rotating said spindle, whereby said power screwdriver can be used as a ratchet type manual screwdriver for screwing-in screws; and the locking means comprising an element movable in a direction parallel to said spindle and engageable with a rotational element rotatable about an axis parallel to said spindle.

18. A handheld power screwdriver, comprising:

a casing;

a reversible electric motor in said casing;

switching means for switching said motor on and off;

selecting means for selecting the rotational direction of said motor;

a spindle having a screwdriver bit holder and being rotatably mounted in said casing for rotation by said motor in screwing and unscrewing directions, respectively;

first ratchet means, operative between said casing and said spindle, for locking said spindle against rotation in the unscrewing direction relative to said casing but allowing rotation of said spindle relative to said casing in the screwing direction;

second ratchet means, operative between said casing and said spindle, for locking said spindle against rotation in the screwing direction reltive to said casing but allowing rotation of said spindle relative to said casing in the unscrewing direction;

said switching means being interconnected with said first and second ratchet means to render both said first and second ratchet means inoperative for locking said spindle relative to said casing when said switching means switches said motor on;

said selecting means being interconnected with said first and second ratchet means to render said first and second ratchet means inoperative, respectively, when said selecting means selects the rotational direction of said motor for the unscrewing and screwing directions, respectively, of said spindle; and said switching means, said selecting means, said first ratchet means, and said second ratchet means interrelating to enable said power screwdriver to function as a ratchet type manual screwdriver when either direction of rotation of said motor is selected by said selecting means but said motor is switched off.

19. The screwdriver of claim 18, wherein said selecting means has a neutral position in which neither direction of rotation of said motor is authorized, and when said motor is switched off and said selecting means is in said neutral position said spindle is locked against rotation relative to said casing in both said screwing and unscrewing directions by the combined operation of said first and second ratchet means.

20. A portable power screwdriver, comprising:

a casing;

a tool holder spindle rotatably mounted in said casing for rotation relative to said casing in either of two opposite directions of rotation;

an electric motor mounted in said casing for drivingly rotating said spindle;

means for switching said motor on and off;

a one way ratchet mechanism connected between said casing and said spindle and operative when said motor is switched off to enable said power screwdriver to function as a ratchet type manual screwdriver; and means, interconnected with said switching means and operated thereby, for disconnecting said ratchet mechanism from being operative between said casing and said spindle, and so freeing said spindle for rotation relative to said casing in either of said directions of rotation, when said motor is switched on.

21. A portable power screwdriver, comprising:

a casing;

a tool holder spindle rotatably mounted in said casing;

an electric motor mounted in said casing for drivingly rotating said spindle;

means for switching said motor on and off;

a one way ratchet mechanism connected between said casing and said spindle and operative when said motor is switched off to enable said power screwdriver to function as a ratchet type manual screwdriver; and said ratchet mechanism comprising:

an element mounted in said casing for movement in a direction parallel to said spindle;

a member rotatably mounted in said casing and connected to said spindle for rotation therewith;

resilient means for urging said element towards a face of said member; and means, on said face of said member, for cooperating with said element, when urged into contact therewith by said resilient means, to permit rotation of said member in one direction of rotation thereof relative to said casing but at the same time to lock said member against rotation relative to said casing in a direction opposite to said one direction.

* * * * *